US006079187A

United States Patent [19]

Velderman et al.

[11] Patent Number: 6,079,187

[45] Date of Patent: Jun. 27, 2000

[54] APPARATUS FOR PACKAGING FLEXIBLE DUCT FOR SHIPMENT AND METHOD FOR PERFORMING THE SAME

[75] Inventors: Jeffrey D. Velderman, Holland; Jeff L. Lampen, Hamilton; Russell L. Ver Brugge; Steve Brandsen, both of Holland, all of Mich.

[73] Assignee: Hart & Cooley, Inc., Holland, Mich.

[21] Appl. No.: 09/201,744

[22] Filed: Dec. 1, 1998

Related U.S. Application Data

[66] Substitute for application No. 60/071,486, Jan. 13, 1998.

[51] Int. Cl.[7] ..... B65B 63/02

[52] U.S. Cl. ..... 53/436; 53/438; 53/527; 53/529

[58] Field of Search ..... 53/436, 439, 523, 53/527, 529, 530

[56] References Cited

U.S. PATENT DOCUMENTS

| | | | |
|---|---|---|---|
| 2,847,808 | 8/1958 | Romine . | |
| 3,385,208 | 5/1968 | Clegg | 53/529 X |
| 3,501,890 | 3/1970 | Hunt . | |
| 3,633,329 | 1/1972 | Nadler | 53/436 |
| 3,808,766 | 5/1974 | Hutchinson et al. | 53/527 X |
| 3,818,673 | 6/1974 | Rollins et al. . | |
| 3,827,210 | 8/1974 | Smalley et al. | 53/436 X |
| 3,939,622 | 2/1976 | Murphy et al. | 53/436 X |
| 4,235,063 | 11/1980 | Paetz | 53/436 |
| 4,619,103 | 10/1986 | Kenrick | 53/436 X |
| 4,885,899 | 12/1989 | Hutchinson | 53/527 |

*Primary Examiner*—Daniel B. Moon

*Attorney, Agent, or Firm*—Raker, Fishman, Grauer & McGarry

[57] ABSTRACT

An apparatus and method for compressing a flexible duct into a shipping container. The flexible duct is placed within a housing and compressed by a plate moving in the housing. As the duct is compressed, the duct is inserted into the container.

59 Claims, 5 Drawing Sheets

APPARATUS FOR PACKAGING FLEXIBLE DUCT FOR SHIPMENT AND METHOD FOR PERFORMING THE SAME

CROSS-REFERENCE TO RELATED APPLICATIONS

This application claims the benefit of U.S. patent application Ser. No. 60/071,486, filed Jan. 13, 1998.

BACKGROUND OF THE INVENTION

1. Field of the Invention

This invention relates to an apparatus and a method for packaging articles for shipment and, more specifically, an apparatus and a method for axially compressing an extended article into the package for shipment.

2. Description of the Related Art

Insulated flexible duct is typically used in heating and cooling applications for transporting climate-controlled air and other gases. The duct is normally comprised of an insulating material such as fiberglass disposed between inner and outer liners formed of a flexible plastic or foil material. Often, a helical reinforcing member is disposed within the duct to provide additional structure and resiliency thereto. In either case, the duct can be axially collapsed to a length shorter than a fully extended length of the duct.

These types of axially-collapsible ducts typically have a high volume-to-weight ratio which makes packaging and shipment of these ducts difficult and costly. For many modes of transporting the packaged ducts, the cost of shipping these items is not only based on weight but also volume. While the weight of these types of axially-collapsible ducts is typically not significant, the volume occupied by these ducts in a fully extended position results in substantial shipping costs. In addition, the fully extended lengths of these axially-collapsible ducts render them awkward to handle and store during the manufacture, transportation, and installation thereof.

Several attempts have been made to provide an apparatus and a method for packing insulated flexible duct into a container which is axially shorter than the fully extended position of the duct. Examples of these attempts are shown in U.S. Pat. No. 3,827,210 (Smalley et al.) issued Aug. 6, 1974, U.S. Pat. No. 3,939,622 (Murphy et al.) issued Feb. 24, 1976, U.S. Pat. No. 4,235,063 (Paetz) issued Nov. 25, 1980, and U.S. Pat. No. 4,619,103 (Kenrick) issued Oct. 28, 1986.

SUMMARY OF THE INVENTION

The invention provides a new method and apparatus for packaging flexible duct and is an improvement over previous methods and apparatuses. The invention comprises an apparatus having an elongated housing with an outlet. The housing is adapted to receive a length of flexible duct, preferably in an uncompressed state. A plate is positioned within the housing and connected to a drive mechanism for moving the plate toward and away from the housing outlet along a line of travel, compressing the duct as the plate moves towards the housing outlet. A container holder is positioned at the housing outlet and is adapted to hold a container in an open position in the line of travel to receive the flexible duct. A first retractable retainer is provided and is movable between an extended position where the retractable retainer is within the first open end of a container in the line of travel and a retracted position where the retractable retainer is clear of the container open end. A closing mechanism is positioned near the container holder and has at least one movable member adapted to close a flap over the end of the container. The closing mechanism partially closes a container around a flexible duct within the container when a first end of the flexible duct is held by the first retractable retainer in the open container after being compressed and moved along the line of travel by the driving mechanism. Additionally, the movable member of the closing mechanism closes the flap on the container open end around the first retractable retainer before the retractable retainer is retracted.

Preferably, the first retractable retainer is a retaining fork adapted to pass through openings in an open end of a container and abut and hold a compressed flexible duct within the container as the movable member closes the container open end by moving a flap of the container over the container open end. A second retainer can be included to hold an opposing end of a compressed flexible duct. Similarly, an opposing end of a container can be closed around the second retainer by moving a flap of the opposing end of the container over the opposing open end.

In a second embodiment, the invention comprises an apparatus for packaging a flexible duct in a container. The apparatus comprises an elongated housing having an outlet and a hingedly mounted lid movable between an open position adapted to receive a flexible duct in the housing and a closed position adapted to retain a flexible duct in the housing. A container holder is positioned at the housing outlet and is adapted to hold a container in an open position for receiving a flexible duct. A plate is positioned within the housing and connected to a driving mechanism for moving the plate toward and away from the housing outlet along a line of travel. As the plate is moved by the driving mechanism toward the housing outlet, the flexible duct placed within the elongated housing is compressed and moved into a first open end of a container held by the container holder at the housing outlet.

In a third embodiment, the invention is a method of packaging a flexible duct in a container of the type having a box-like exterior with upper, lower and opposing side walls that define opposing front and rear open ends, and at least one flap associated with at least one of the walls to close the open ends. The method comprises the holding of an erect container so that the front open end of the container is aligned with the flexible duct; compressing the flexible duct and inserting the compressed flexible duct into the container through the front container open end; placing a container adjacent the front open end to hold the compressed flexible duct in the container; closing the flap over the container front open end while the retainer is holding the compressed flexible duct in the container; and, then sealing the flap to the container to enclose the compressed flexible duct in the container.

BRIEF DESCRIPTION OF THE DRAWINGS

The invention will now be described with reference to the drawings in which.

DETAILED DESCRIPTION OF THE PREFERRED EMBODIMENTS

Figures 1, 2:
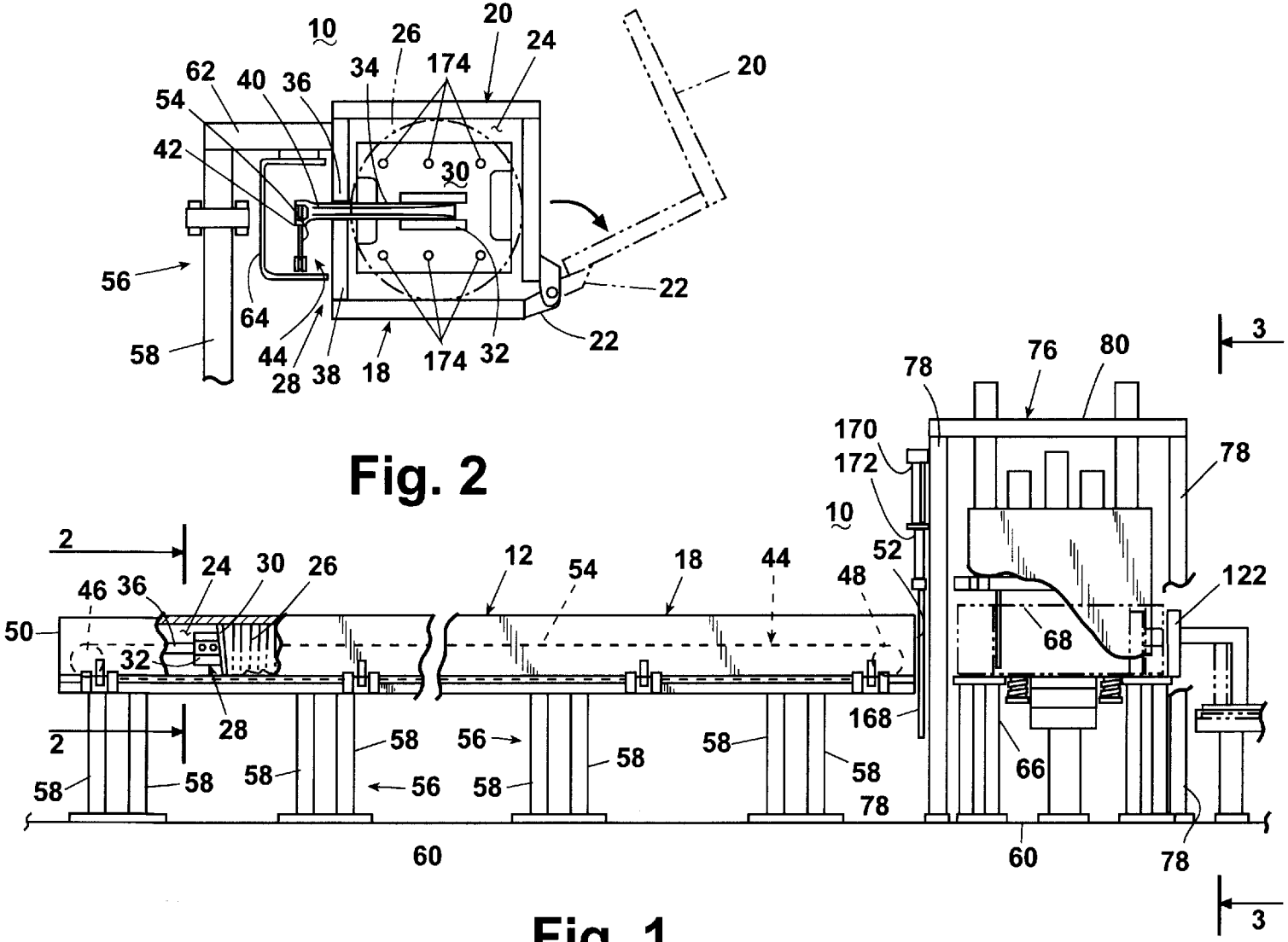
FIG. 1 shows a side elevational view of an apparatus for axially compressing an elongated insulated flexible duct into a box and closing and taping flaps on the box to enclose the compressed duct therein for shipment according to the invention.
FIG. 2 is a cross-sectional view of the duct-packaging apparatus taken along lines 2—2 of FIG. 1 showing a hinged cover for an elongated channel which receives the insulated flexible duct in a closed position (solid line) and an open position (phantom line)
Figure 3:
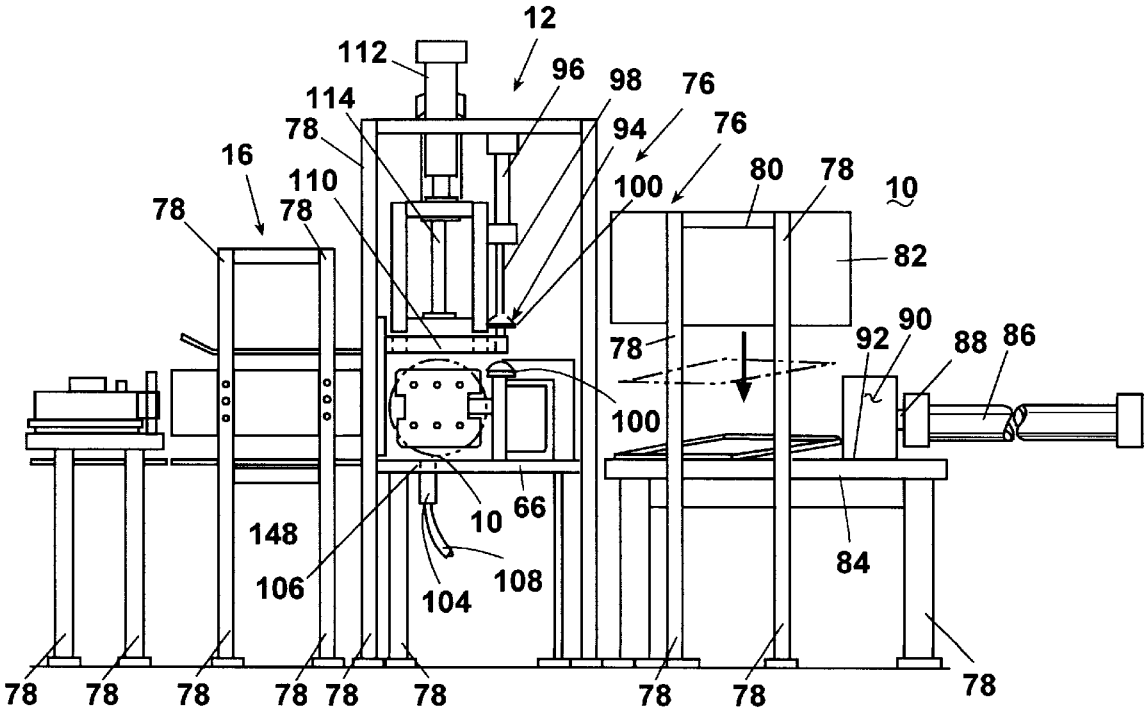
FIG. 3 is an end elevational view taken along lines 3—3 of FIG. 1 showing a box-erecting apparatus and a flap closing and taping apparatus of the duct-packaging apparatus of FIG. 1.

Referring now to the drawings and to FIGS. 1–3 in particular, a duct-packaging system 10 is shown comprising a duct compressing apparatus 12, a box erecting apparatus 14, and a flap closing and taping apparatus 16. It will be understood that, according to the invention, the box erecting apparatus 14 erects and holds a box which receives an axially-compressed duct from the duct compressing apparatus 12. The duct compressing apparatus 12 retains the duct in a compressed state while flaps on the box are closed and taped by the flap closing and taping apparatus 16.

Referring now to FIGS. 1–2, the duct compressing apparatus 12 comprises an elongated housing 18 which has a cover 20 pivotally mounted thereto by a hinge 22. The cover 20 is shown in FIG. 2 in solid lines in a closed position and in phantom lines in an open position. The housing 18 and the cover 20 cooperate to define an internal chamber 24 when the cover 20 is in the closed position. Although the housing 18 and cover 20 are shown as a pair of opposing L-shaped members which cooperate to define a chamber 24 having a rectangular cross-section, alternative arrangements for the housing 18 and the cover 20 can be provided without departing from the scope of this invention.

As shown in the drawings, the cover 20 preferably extends substantially the longitudinal length of the housing 18 so that, when the cover 20 is pivoted to the opened position, an elongated, axially-compressible duct 26 can be easily laid into the internal chamber 24.

The duct compressing apparatus also includes a driving mechanism 28 comprising a plate 30 movably supported with respect to the housing 18 by a flange 32. The flange 32 is mounted to the plate 30 and to an arm 34. An elongated slot 36 is provided in a side wall 38 of the housing 18. Alternatively, the slot 36 can be provided in a sidewall of the cover 20 without departing from the scope of this invention. The arm 34 has a distal end 40 which projects through the lot 36 in the sidewall 38 of the housing 18 and is provided with an inverted C-shaped flange 42 mounted to a chain drive 44. The chain drive 44 generally comprises first and second sprockets 46 and 48 located adjacent first and second ends 50 and 52, respectively, of the housing 18 interconnected by an endless link chain 54.

At least one of the first and second sprockets 46 and 48 is driven by a conventional motor (not shown) which is selectively actuatable by a user.

Actuation of the motor drives the chain 54 around the first and second sprockets 46 and 48 which, in turn, drives the plate 30 between the first and second ends 50 and 52 of the housing 18 depending upon the direction of actuation of the motor. It has been found that providing the C-shaped flange 42 of the distal end 40 of the arm 34 with a removable connection with the chain 54 allows the plate 30 to be selectively positioned between the first and second ends 50 and 52 of the housing 18 to allow duct 26 of any axial length shorter than the housing to be received within the housing 18.

A frame 56 supports the housing 18 which comprises several depending legs 58 which extend between the housing 18 and a ground surface 60. The legs 58 can be provided with laterally-extending members 62 disposed between the legs 58 and the housing 18 to provide support and clearance for the driving mechanism 28. Additionally, a shroud 64 is provided over the driving mechanism 28 for safety purposes. The shroud 64 is preferably removable for convenient access to the components of the driving mechanism 28 for installation, repair or otherwise.

Figure 4:
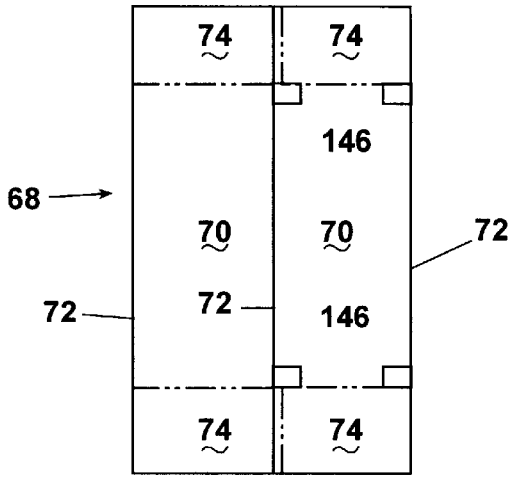
FIG. 4 is a top plan view of an example of a box used in the duct packaging apparatus of FIG. 1 in a collapsed state.

A platform 66 is provided adjacent the second end 52 of the housing 18 and is adapted to support a box 68 thereon at a height vertically aligned with the second end 52 of the housing 18. A collapsed box 68 is shown in FIG. 4 comprising a standard rectangular member with four walls 70 interconnected by folds 72 and provided with flaps 74 at each end of a wall 70. It will be understood that, from the perspective of FIG. 4, the box 68 is shown in a collapsed state whereby only two of the four walls 70 are shown in the drawing with the remaining two walls 70 provided beneath those walls shown. The box erecting apparatus 14 is provided to facilitate the placement of the box 68 into an erected position on the platform 66 to receive the duct 26 located within the internal chamber 24 of the housing 18. The platform 66 is positioned within a housing frame 76 which generally comprises several vertical members 78 which support several horizontal members 80 thereon above the ground surface 60 for supporting various components of the duct compressing apparatus 12, box erecting apparatus 14 and the flap closing and taping apparatus 16. It will be understood that the specific arrangement and configuration of the frame is selected and assembled to support the various components of the system 10 at the proper pre-selected vertical and horizontal heights.

The box erecting apparatus 14 comprises a dispensing unit having a box magazine 82 supported on the frame 76 above a platform 84. The platform 84 is preferably located laterally adjacent to the platform 66 and is vertically aligned therewith so that the adjacent platforms 66 and 84 form a substantially contiguous horizontal surface. A cylinder 86 having an axially-extendable piston 88 therein is provided adjacent to the platform 84 and preferably parallel therewith. The piston 88 has a transversely-extending flange 90 thereon which has a lower edge 92 located directly adjacent an upper surface of the platform 84. The piston 88 is preferably moveable between a retracted position wherein the flange 90 is not beneath the magazine 82 and an extended position whereby the flange extends across the platform 84 and onto the platform 66.

The magazine 82 receives a supply of collapsed boxes as shown in FIG. 4 and is adapted to selectively dispense a box 68 onto the platform 84.

A suction cup 94 is movably mounted to the frame 76 by a cylinder 96 having an axially-extendable piston 98 therein. The suction cup 94 preferably comprises an inverted cup-shaped member having an annular lip 100 thereon. The suction cup 94 is preferably interconnected with a vacuum source (not shown).

The platform 66 is provided with a vacuum port 102 which comprises a socket 104 extending through a bore 106 in the platform 66 and interconnects to a vacuum source (not shown) by an appropriate sealed conduit 108.

The frame 76 is also provided with several retractable members which are adapted to be moved into position around the box 68 on the platform 66 so that the box 68 is positioned to receive the duct 26 from the housing 18. The retractable members support the walls 70 of the box 68 and prevent movement thereof during compression of the duct 26 into the box 68.

A top plate 110 is movably supported on the frame 76 by a cylinder 112 having an axially-extendable piston 114 thereon. The top plate 110 can be moved into a lowered position whereby the top plate 110 is placed adjacent to, and supports an upper wall 70 of the box 68. It will be understood that a bottom wall 70 of the box 68 is supported by the platform 66. A first sidewall 70 of the box 68 is supported by the flange 90 when the piston 88 of the cylinder 86 is moved to an extended position adjacent to the box. A second sidewall 70 of the box 68 is supported against a gate 116 which is movably supported with respect to the frame 76 by a cylinder 118 having an axially-extendable piston 120 therein. Thus, the four sidewalls 70 of the box 68 are provided with structural rigidity by the platform 66, flange 90, top plate 110 and gate 116 during compression of the duct 26 into the box 68.

A rear plate 122 is axially aligned with a rear opening of the box 68 on the platform 66. The rear plate 122 is supported by an L-shaped arm 124 which has a lower end 126 mounted to a plate 128. The plate 128 is slidably mounted upon a platform 130 which is vertically positioned at an appropriate height to align the rear plate 128 with the rear opening of the box 68 on the platform 66. A cylinder 132 having an axially-extendable piston 134 therein is pivotally mounted to the plate 128 so that actuation of the cylinder 132 translates the plate 128 with respect to the platform 130. Thus, the rear plate 122 can be moved into position within the rear opening of the box 68 to provide a surface against which a leading end of the duct 26 is compressed as the duct 26 is inserted within the box 68. The rear plate 122 is perforated to permit significant air flow therethrough.

A pair of retaining forks 136 each comprising a pair of depending legs 138 having an upper end mounted to a transversely-extending plate 140 are each movably supported on the frame 76 by a cylinder 142 having an axially-extendable piston 144 mounted to the plate 140. The legs 138 are preferably provided in a spaced relationship so that each is aligned with one of the four vertical corners of the interior of the box 68. As seen in FIG. 4, the box 68 can be provided with spaced apertures 146 located adjacent each vertical comer for receipt of the depending legs 138 on the retaining forks 136. The retaining forks 136 are lowered into the box 168 after the duct 26 has been compressed therein so that the legs 138 retain the duct 26 within the box 68 so that the flaps 74 on the box 68 can be closed and taped without the inadvertent expansion of the duct 26. It will be understood that the retaining forks 136 are preferably located adjacent to both of the forward and rearward openings of the box. Alternatively, the retaining forks 136 could be provided with a thin plate which is adapted to be inserted into the box 68 adjacent the openings at each forward and rearward end thereof.

The flap closing and taping apparatus 16 is located on the opposite side of the platform 66 from the platform 84 of the box erecting apparatus 14. The apparatus 16 comprises a platform 148 mounted to the frame 76, preferably in vertical alignment with the platform 66. A chute formed from a pair of side plates 150 and 152 and a top plate 154 are mounted to the frame 76 and define a passageway through which a box 68 exits the duct compressing apparatus 12 and box erecting apparatus 14 after being filled with a compressed duct 26.

The plates 150 and 152 are provided with converging end portions 156 which receive the flaps 74 on the box 68 and urge them toward a closed position enclosing the duct 26 therein. A pair of packaging tape supply rolls 158 are rotatably mounted upon platforms 160 mounted to the frame 76 adjacent each lateral side of the platform 148. Each platform 160 includes a slack roller 162 and an application roller 164 which applies a length of packing tape 166 to the box 68 as it exits the passageway defined by the plates 150–154.

The operation of the system 10 according to the invention will now be described with particular reference to the illustrations shown in FIGS. 5–12.

Figure 5:
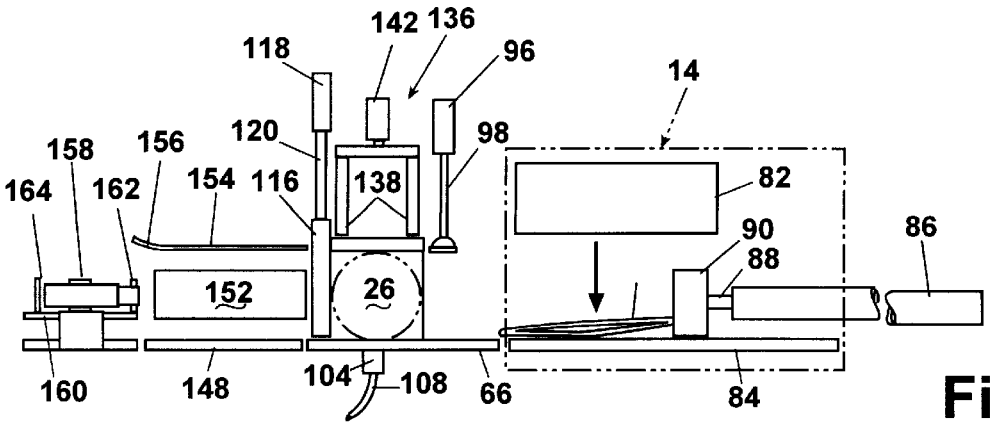
FIG. 5 is an end elevational view of the duct-packaging apparatus of FIG. 1 showing the unerected box shown in FIG. 4 deposited into an initial position within the box-erecting apparatus of FIG. 3 with the remaining portions of the duct-packaging apparatus removed for purposes of clarity.

As shown in FIG. 5, a collapsed box 68 is dispensed from the box magazine 82 of the box erecting apparatus 14 onto the platform 84 while the cylinder 86 has its piston 88 and associated flange 90 in the retracted position.

Figure 6:
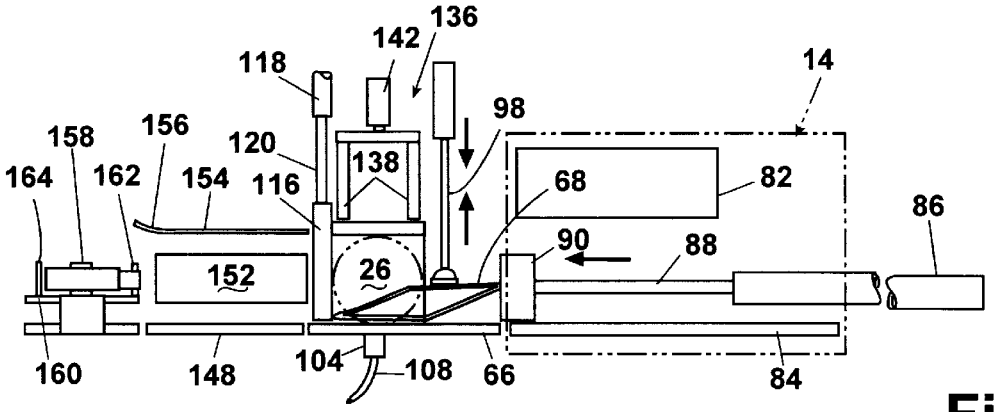
FIG. 6 is an end elevational view of the duct-packaging apparatus of FIG. 1 showing a partially erected box within the apparatus of FIG. 3 with the remaining portions of the duct-packaging apparatus removed for purposes of clarity.

As shown in FIG. 6, the collapsed box 68 is pushed by the cylinder 86 by extending the piston 88 and its associated flange 90 across the platform 84 and onto the platform 66. The cylinder 96 is actuated to lower the piston 98 and its associated suction cup 94 to contact an upper sidewall 70 of the box 68. Vacuum is applied to both the suction cup 94 and the vacuum port 102 of the socket 104 to retain the upper sidewall 70 against the suction cup 94 and the lower sidewall 70 against the platform 66, respectively.

Figure 7:
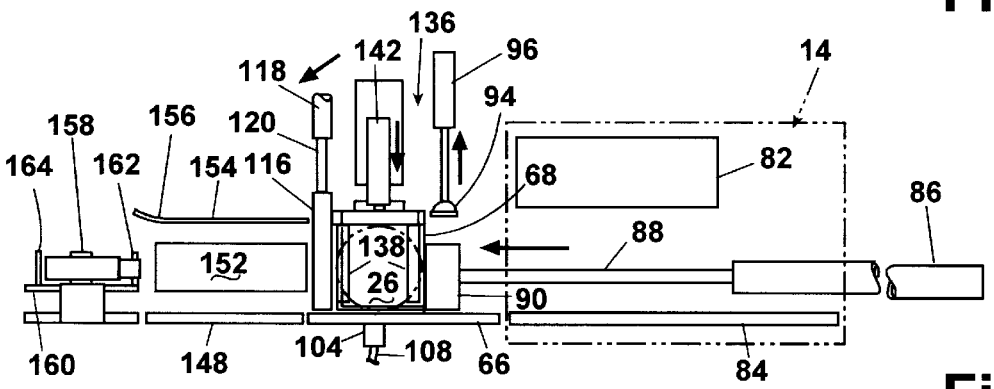
FIG. 7 is an end elevational view of the duct-packaging apparatus of FIG. 1 showing a fully erected box deposited into an initial position within the box-erecting apparatus of FIG. 3 with the remaining portions of the duct-packaging apparatus removed for purposes of clarity.

As seen in FIGS. 6–7, the piston 98 and is associated suction cup 94 is lifted upwardly simultaneous with continued lateral movement of the piston 88 and its associated flange 90. The suction cup 94 applies a vacuum to the upper sidewall 70 of the box 68 and lifts the upper sidewall 70. The flange 90 abuts a fold 72 located between the upper sidewall 70 and a lateral sidewall 70 of the box 68. The continued lateral movement of the flange 90 pushes the fold 72 so that the box 68 expands into an upright, erected position as shown in FIG. 7. When the box 68 has been lifted a sufficient amount, the vacuum can be deactivated to the suction cup 94 and the cylinder 96 can be actuated to lift the suction cup 94 out of the path of the flange 90 as it is further laterally moved by the cylinder 86.

Figure 8:
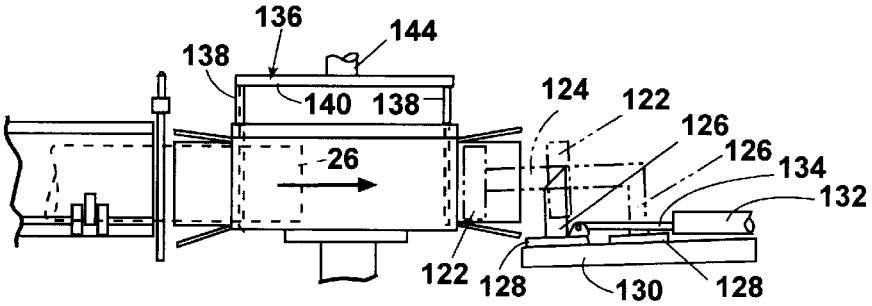
FIG. 8 is a side elevational view of the duct-packaging apparatus of FIG. 1 showing the duct being collapsed within the box, a rear plate portion moved into position adjacent a distal end of the box, and a retaining member shown in a raised non-engaging position (solid lines) and a lowered retaining position (phantom lines)

FIG. 7 shows the fully-erected box 68 positioned beneath the top plate 110, between the gate 116 and extended flange 90, positioned on the platform 66 and retained thereto by the vacuum applied through the suction port 102. These members support the sidewalls 70 of the box 68 and provide additional rigidity thereto. As shown in FIG. 8, the rear plate 122 is moved into position by actuation of the cylinder 132 which extends the piston 134 therefrom which, in turn, translates the plate 128 with respect to the platform 130 and positions the rear plate 122 within the rear opening of the box 68. In addition, the rear retaining fork 136 is lowered into position within the box 68 by actuating the cylinder 142. The box 68 is in position to receive a length of compressed duct 26 therein.

The compression of the duct 26 into the box 68 will be described with reference in particular to FIGS. 1–4 and 8. The cover 20 is moved to the open position to expose the internal chamber 24 of the housing 18. A length of elongated duct 26 can be laid in the internal chamber 24 between the first and second ends 50 and 52 of the housing 18. It will be understood that the driving mechanism 28 is positioned behind a trailing end of the duct 26.

The duct 26 positioned within the housing 18 preferably undergoes a pre-compression cycle prior to being inserted into the box 68 positioned on the platform 66. In this manner, a pre-compression gate 168 is lowered by a cylinder 170 having an axially-extendable piston 172 thereon. The gate 168 comprises a pair of forks, like the retaining forks, or comprises a single perforated plate with sufficient apertures to permit significant air flow therethrough. The gate 168 is lowered over the second end 52 of the housing 18. The gate 168 provides a retractable end wall to the housing 18 so that the duct 26 located therein cannot exit from the housing 18 until the gate 168 is retracted. In this manner, the duct is compressed against the gate 168 by actuation of the motor which drives the chain 54 around the sprockets 46 and 48 and, in turn, moves the arm 34 along the chain 54. The plate 30 attached to the arm 34 through the flange 32 is driven against the trailing end of the duct 26 and compresses the duct 26 between the plate 30 and the gate 168.

As shown in FIG. 2, the plate 30 is provided with several apertures 174 which exhaust air from within the duct 26 as the duct 26 is compressed. It will also be understood that the plate 30 extends laterally across the internal chamber 24 of the housing 18 and defines a gap adjacent either lateral edge of the plate 30 to allow the depending legs 138 of a retaining fork 136 to be extended adjacent each lateral side thereof.

Once the pre-compression cycle is completed, the cylinder 170 is actuated which lifts the gate 168 out of obstruction of the second end 52 of the housing 18. The motor is actuated to continue the longitudinal movement of the plate 30 with respect to the housing 18 so that the compressed duct 26 is transported past the second end 52 of the housing 18 and into the erected box 68. The duct 26 is urged by the plate 30 so that the leading edge of the duct 26 contacts the depending legs 138 of the rear retaining fork 136 and the rear plate 122 located within the rear opening of the box 68. Once the compressed duct 26 is urged completely within the box 68, the depending legs 138 of the forward retaining fork 136 are lowered adjacent to the forward opening of the box 68. The compressed duct 26 is thereby retained between the depending legs 138 of the forward and rearward retaining forks 136.

As shown in FIG. 8, the rear plate 122 is then retracted out of the rear opening of the box 68 by actuation of the cylinder 132. The box 68 then has the compressed duct 26 between the forward and rearward retaining forks 136.

Figure 9:
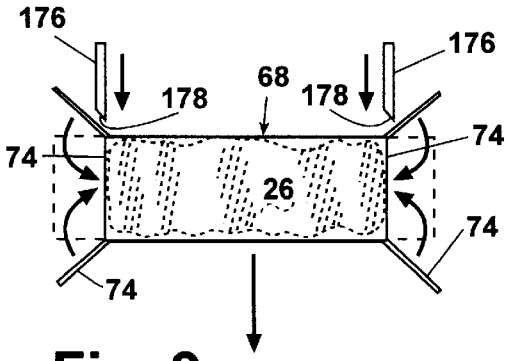
FIG. 9 is a top plan view of the duct-packaging apparatus of FIG. 1 showing a pair of plates which are adapted to close a pair of side flaps located at each end of the box with the remaining portions of the duct-packaging apparatus removed for clarity.

The flaps 74 must now be closed over the forward and rearward openings of the box 68. As shown in FIG. 9, a pair of sliding plates 176 having a leading ramped edge 178 thereon are slidably mounted adjacent the flange 90 of the cylinder 86. The plates 176 are slid laterally with respect to the box 68 so that the ramped edge 178 contacts a side flap 74 of the box 68 and folds it into a closed position over each end of the box 68. The cylinder 86 is then actuated to further extend the piston 88 and its associated flange 90 which pushes the box 68 containing the duct 26. The forward and rearward retaining forks 136 are lifted by their associated cylinders 142 so that the depending legs 138 on each retaining fork 136 are lifted out of obstruction of the movement of the box 68.

As the flange 90 is urged against the box 68, an opposite side flap 74 is urged against the angular end portions 156 of the side plates 150 and 152 within the flap closing and taping apparatus 16. The side flaps 74 of the box 68 are thereby closed over each end of the box 68.

The top and bottom flaps 74 of the box 68 are closed by the engagement of an outer edge of the top and bottom flaps 74 of the box 68 against angular ridges (not shown) along the interior of the side plates 150 and 152 which cam the top and bottom flaps into a closed position over the previously-closed top and bottom side flaps 74 thereof.

Figure 10:
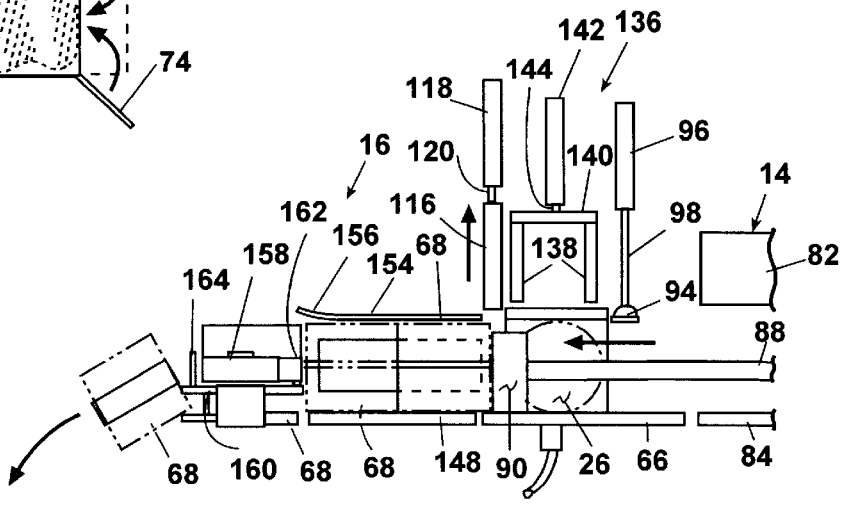
FIG. 10 is an end elevational view of the duct-packaging apparatus of FIG. 1 showing the duct packaged within the box ejected from the box-erecting apparatus into a flap closure and taping apparatus.

As shown in FIG. 10, boxes 68 containing the compressed ducts 26 are arranged in a queue fashion between the side plates 150 and 152, the top plate 154 so that they are indexed along the platform 148. A leading box 26 exits from between the plates 150–154 whereby the closed top and bottom flaps 74 on each end of the box 68 encounter the packaging tape 166 which is urged against a seam between the closed top and bottom flaps 74 on the box 68 whereby the application roller 164 and the slack roller 162 cooperate to apply a tight strip of packing tape 166 thereover.

The urging of the next successive box 68 causes the box located between the packaging tape supply rolls 158 to fall off of the platform 148 after the flaps 74 have been taped shut. It will be understood that a conventional tape cutting mechanism is provided adjacent to each packaging tape supply roll 158 to sever the strip of packaging tape 166 after an appropriate length thereof has been applied to each end of the box 68.

The box 68 is now packaged, taped shut, and ready for shipment with a length of compressed duct 26 packaged therein.

Although the mechanism for moving the plate 30 of the driving mechanism 28 is shown as a chain 54 disposed around sprockets 46 and 48 and actuated by motor, it will be understood that alternative driving mechanisms such as a pulley engaged within a rail, a hydraulic cylinder, or a mechanically-driven shuttle can also be used on any other conventional driving mechanism without departing from the scope of this invention. Further, although the main mechanism for driving the moveable components of the box erecting apparatus 14 and the flap closing and tape apparatus 16 are disclosed herein as pneumatic cylinders with actuated axially-extendable pistons, alternative driving mechanisms such as chains, gears, rotors, or electrical, hydraulic, pneumatic or fuel-driven motors can be used without departing from the scope of the invention as well.

Figure 11:
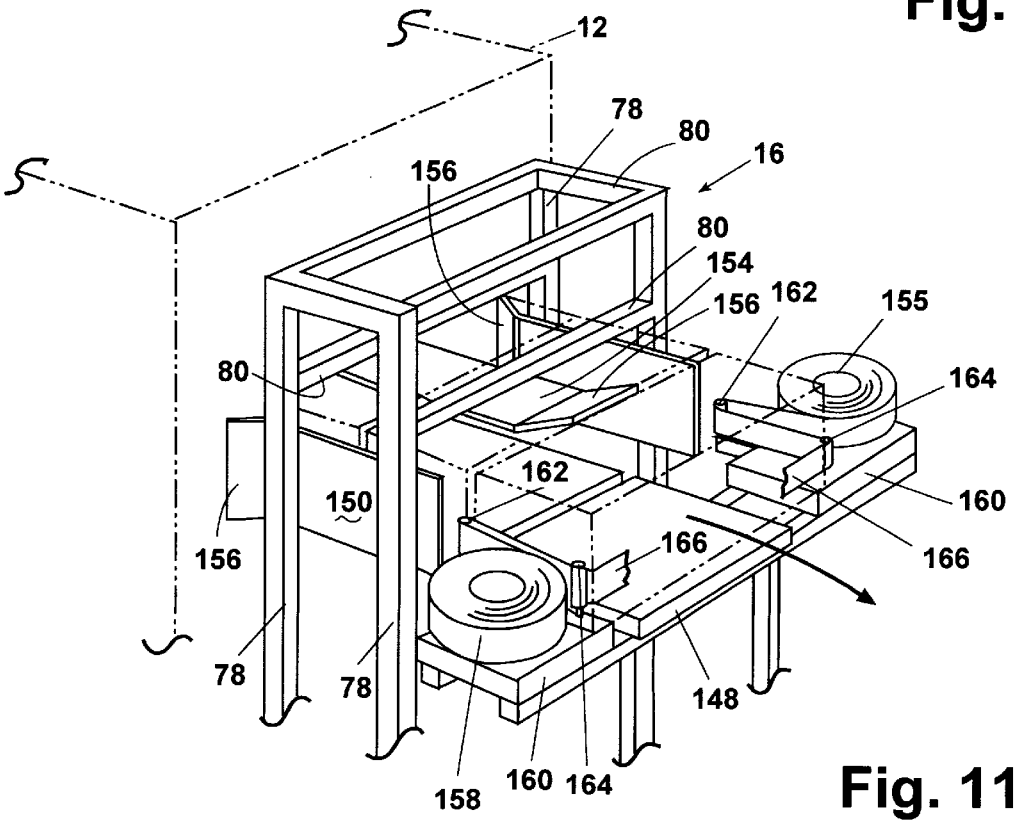
FIG. 11 is a perspective view of the flap closure and taping apparatus of FIG. 10 with the remaining portions of the duct-packaging apparatus removed for clarity.
Figure 12:
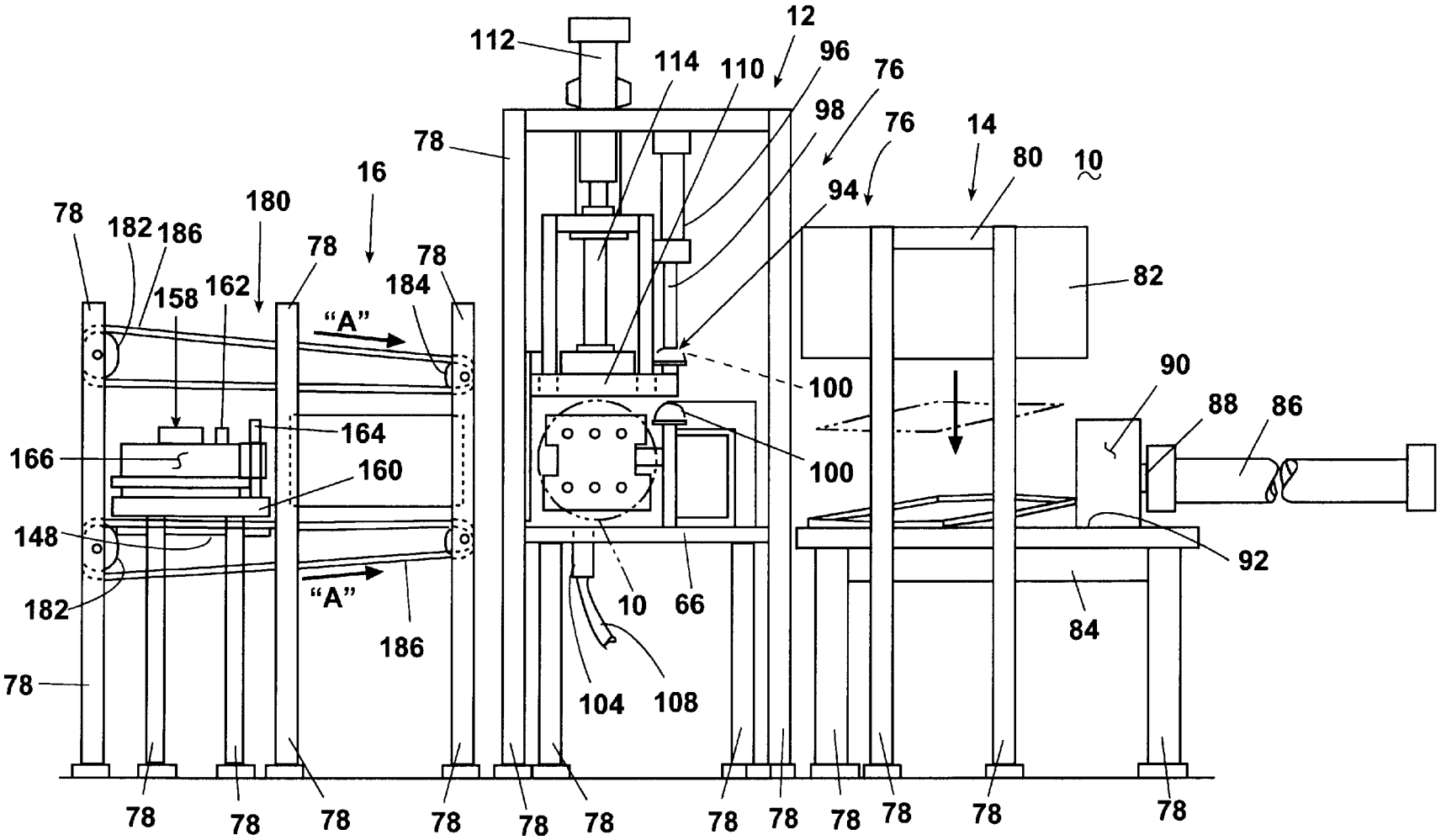
FIG. 12 is an end elevational view of the duct-packaging apparatus of FIG. 1 showing the duct packaged within the box ejected from the box-ejecting apparatus into an alternative embodiment of the flap closure and taping apparatus shown in FIGS. 10–11.

FIG. 12 shows an alternative embodiment of the flap closure and taping apparatus shown in FIGS. 10–11. Instead of indexing the boxes 68 through the flap closure and taping apparatus by a queue mechanism whereby a next successive box 68 pushes a previously-ejected box 68 between a pair of supply rolls 158 of packaging tape 166, the boxes 68 which are pushed from the platform 66 by the flange 90 on the cylinder 86 are urged between a pair of vertically-spaced drive mechanisms 180 which mechanically urge the box 68 along the platform 148 between the platforms 160 containing the supply rolls 158 of packaging tape 166.

Each drive mechanism 180 comprises first and second pulleys 182 and 184 rotatably mounted to vertical members 78 of the frame 76 surrounding the flap closure and taping apparatus 16. An endless belt 186 is wrapped around each set of pulleys 182 and 184 and is driven in the direction designated by the arrows "A" by a conventional motor (not shown). The belt 186 is preferably formed from a material which has a frictional coefficient selected to engage the material comprising the box 68 and to urge the box 68 between the drive mechanisms 180 when the belts 186 are actuated by the motor.

The remaining operation of the flap closure and taping apparatus shown in FIG. 12 is as described with respect to the previous embodiment shown in FIGS. 10–11. It will be understood that elements common to both embodiments shown in FIGS. 10–11 and FIG. 12 are identified with common reference numerals.

While particular embodiments of the invention have been shown, it will be understood, of course, that the invention is not limited thereto since modifications may be made by those skilled in the art, particularly in light of the foregoing teachings. Reasonable variation and modification are possible within the scope of the foregoing disclosure of the invention without departing from the spirit of the invention.

The embodiments for which an exclusive property or privilege is claimed are defined as follows:

1. An apparatus for packaging a flexible duct in a container of the type having a box-like exterior comprising opposing side walls that define first and second opposing open ends, and flaps associated with at least one of the walls to close the open ends, the apparatus comprising:

an elongated housing having an outlet and adapted to receive a length of flexible duct;

a plate positioned within the housing and connected to a driving mechanism for moving the plate toward and away from the housing outlet along a line of travel for urging a flexible duct out of the housing through the outlet;

a container holder positioned at the housing outlet and adapted to hold a container in an open position in the line of travel for receiving a flexible duct as it is urged through the outlet;

a first retractable retainer, moveable in a direction generally transverse to the line of travel between an extended position where it is within a first open end of a container in the line of travel and a retracted position where it is clear of the container; and a closing mechanism positioned near the container holder and having at least one moveable member adapted to close a flap over an open end of the container;

whereby a container will be partially closed by the closing mechanism around a flexible duct when a first end of the flexible duct is held by the first retractable retainer in the open container after being compressed and moved along the line of travel by the driving mechanism into a first open end of the container, and the at least one moveable member closes a flap on a container open end around the first retractable retainer before the retractable retainer is retracted.

2. The packaging apparatus according to claim 1, and further comprising:

a container dispenser adjacent the container holder and adapted to dispense a container;

a container sealer adjacent the closing mechanism and adapted to seal a closed end of the container; and a container mover adapted to move a dispensed container from the container dispenser to the container holder for insertion of a compressed duct and move the container from the container holder to the container sealer.

3. The packaging apparatus according to claim 1 wherein the elongated housing has a hingedly mounted lid moveable between an open position adapted to receive a flexible duct in the housing and a closed position adapted to retain a flexible duct in the housing.

4. The packaging apparatus according to claim 1 wherein the container holder comprises a platform adapted to support a collapsed container and a lifting device adapted to lift a portion of the container to erect the collapsed container on the platform.

5. The packaging apparatus according to claim 4 wherein the lifting device is a suction cup moveable between a retracted position and an extended position where the suction cup is adapted to attach to an upper wall of a collapsed container in the extended position and erect the container as the suction cup moves to the retracted position where the platform supports a bottom wall of the container.

6. The packaging apparatus according to claim 5 wherein the container holder further comprises a support wall moveable between a retracted and an extended position where the support wall is adapted to support a side wall of a container.

7. The packaging apparatus according to claim 6 wherein the container holder further comprises an arm moveable between a retracted and extended position where the arm is opposite the support wall and adapted to erect the container in conjunction with the suction cup by abutting and raising a container side wall as the arm moves between the retracted and extended positions and support the container side wall in the extended position.

8. The packaging apparatus according to claim 7 wherein the container holder further comprises a rear plate moveable between a retracted and an extended position adjacent a container second open end held by the container holder and adapted to support a second end of the flexible duct when in the extended position.

9. The packaging apparatus according to claim 7 wherein the container holder further comprises a vacuum device and the holder platform has a vacuum opening connected to the vacuum device whereby the holder platform is adapted to hold a container lower wall by the suction applied through the vacuum opening by the vacuum device.

10. The packaging apparatus according to claim 9 wherein the container holder further comprises a second retractable retainer, moveable between an extended position where it is within a second end of a container in the line of travel and a retracted position where it is clear of the container.

11. The packaging apparatus according to claim 10 wherein the container holder further comprises a barrier moveable between a retracted and extended position where the barrier is positioned adjacent the housing outlet and in front of the first retractable retainer and adapted to permit the pre-compression of a flexible duct prior to the flexible duct being compressed and moved into a container held by the container holder.

12. The packaging apparatus according to claim 11 wherein the first and second retractable retainers are retaining forks having two tines that are spaced and sized to be received through openings in a container and each tine adjacent an opposite container side wall of an erected container.

13. The packaging apparatus according to claim 10 wherein the closing mechanism moveable member is a flap closing plate moveable between a retracted and extended position and the flap closing plate is adapted to abut a flap associated with the container first open end and move the flap to cover the container first open end and prevent the compressed flexible duct from expanding when the first retainer is removed.

14. The packaging apparatus according to claim 4, and further comprising a container dispenser comprising a magazine adapted to store and dispense collapsed containers and a platform adapted to receive a dispensed collapsed container.

15. The packaging apparatus according to claim 14 wherein the magazine is positioned above the dispenser platform and the dispenser platform is adjacent to the holder platform.

16. The packaging apparatus according to claim 14, and further comprising a container mover adapted to move a dispensed container from the dispenser platform to the holder platform.

17. The packaging apparatus according to claim 16 wherein the container mover comprises a moveable piston having a flange on one end, the piston being moveable between a retracted and extended position where the flange is adapted to move a container from the dispenser platform to the holder platform.

18. The packaging apparatus according to claim 17 wherein the lifting device is a suction cup moveable between a retracted position and an extended position where the suction cup is adapted to attach to an upper wall of a collapsed container in the extended position and erect the container as the suction cup moves to the retracted position while the platform supports a bottom wall of the container.

19. The packaging apparatus according to claim 18 wherein the moveable piston is moveable to a second extended position were the flange is adapted to support a container side wall of a collapsed container and erect the collapsed container in concert with the suction cup.

20. The packaging apparatus according to claim 16, and further comprising a sealing device adapted to seal the open end of a container with a compressed flexible duct inserted within the container.

21. The packaging apparatus according to claim 20 wherein the sealing device comprises a chute with an inlet and an outlet and a tape dispenser positioned at the chute outlet, the chute includes an elongated side plate having a deflector adapted to move a container flap over the container first open end as the container moves through the chute and the tape dispenser is adapted to tape the container flap to the container to seal the container first open end.

22. The packaging apparatus according to claim 16 wherein the container mover comprises a moveable piston having a flange on one end and moveable between a retracted and extended position where the flange is adapted to move a container from the holder platform into the chute.

23. An apparatus for packaging a flexible duct in a container of the type having a box-like exterior comprising opposing side walls that define first and second opposing open ends, and flaps associated with at least one of the wall to close the open ends, the apparatus comprising:

an elongated housing having first and second ends, an outlet at one of the ends, an opening in the housing communicating with an interior thereof, the opening extending substantially the entire length between the first and second ends, and a closure moveable between an open position adapted to receive a substantially uncompressed length of flexible duct in the housing and a closed position adapted to enclose a flexible duct in the housing;

a container holder positioned at the housing outlet and adapted to hold a container in an open position for receiving a flexible duct; and a plate positioned within the housing and connected to a driving mechanism for moving the plate toward and away from the housing outlet along a line of travel whereby the driving mechanism is adapted to compress and move a flexible duct placed within the elongated housing into a first open end of a container held by the container holder at the housing outlet.

24. The packaging apparatus according to claim 23 wherein the container holder further comprises a platform adapted to support a collapsed container, the platform having a vacuum port, a vacuum device connected to the vacuum port, and a suction cup moveable between a retracted position and an extended position whereby the holder platform is adapted to hold a container lower wall by the suction applied through the vacuum port and the suction cup is adapted to attach to a container upper wall in the extended position and erect the container as the suction cup moves to the retracted position.

25. The packaging apparatus according to claim 24 wherein the container holder further comprises first and second spaced retaining forks moveable between a retracted and extended position, each fork having a pair of spaced tines wherein when in the extended position each fork is adapted to be received within a container held by the container holder at a position adjacent one of the container ends and each tine of each fork being adjacent opposite container side walls to thereby retain a compressed flexible duct within the container while permitting the withdrawal of the plate of the driving mechanism between the tines of the first fork.

26. The packaging apparatus according to claim 25 wherein the container holder further comprises a support wall moveable between a retracted and an extended position where the support wall is adapted to support a side wall of a container during the compressing of the flexible duct.

27. The packaging apparatus according to claim 26, and further comprising a dispenser comprising a magazine adapted to store and dispense collapsed containers and a platform positioned below the magazine and adapted to receive a dispensed collapsed container.

28. The packaging apparatus according to claim 27, and further comprising a sealing device having a chute with an inlet adjacent the container holder, an outlet and a tape dispenser positioned at the chute outlet, the chute includes an elongated side plate having a deflector adapted to move a container flap over the container open end as the container moves through the chute and the tape dispenser is adapted to tape the container flap to the container to seal the container open end.

29. The packaging apparatus according to claim 28, and further comprising a container mover having a piston with a flange on one end and moveable between a retracted position adjacent the dispenser platform, a first extended position adjacent the holder platform, a second extended position above the holder platform, and a third extended position adjacent the chute wherein the flange is adapted to move a collapsed container from the dispenser platform to the holder platform as it moves to the first extended position, to erect the container in conjunction with the suction cup in the second extended position, and to move the erected container with a compressed flexible duct to the chute inlet in the third extended position.

30. A method for packaging a flexible duct in a container of the type having a box-like exterior comprising upper, lower and opposing side walls that define opposing front and rear open ends, and at least one flap associated with at least one of the walls to close the open ends, the method comprising:

holding an erect container so that the front open end of the container is aligned with the flexible duct;

compressing the flexible duct into the container along an axial line of travel;

moving a retainer in a direction generally transverse to the line of travel into a position adjacent the front open end to hold the compressed flexible duct in the container;

closing the flap over the container front open end while the retainer is holding the compressed flexible duct in the container; and sealing the flap to the container to enclose the compressed flexible duct in the container.

31. The method according to claim 30 wherein the placing of the retainer adjacent the container front open end further comprises moving a retaining fork having two opposing tines adjacent the front open end after the flexible duct is compressed within the container beyond the container front open end and a first end of the flexible duct abutting the tines to retain the flexible duct within the container.

32. The method according to claim 31 wherein the tines pass through openings in the container and each tine is adjacent an opposite container side wall.

33. The method according to claim 32 wherein the compressing of the flexible duct in the container includes pressing a plate against the flexible duct first end until the flexible duct first end is compressed into the container front end, inserting the tines through the openings in the container after the flexible duct is compressed, and withdrawing the plate between the inserted tines.

34. The method according to claim 30 wherein the compressing of the flexible duct comprises placing the flexible duct into a housing shaped to receive the flexible duct.

35. The method according to claim 34 wherein the compressing of the flexible duct further comprises moving a plate located in the housing toward an outlet of the housing with the plate abutting the first end of the flexible duct to compress the flexible duct as the plate moves towards the outlet.

36. The method according to claim 35 wherein the compressing of the flexible duct further comprises closing the container rear open end.

37. The method according to claim 36 wherein the closing of the container rear open end includes moving a plate adjacent the rear open end.

38. The method according to claim 36 wherein the closing of the rear open end includes moving a flap to close the rear open end.

39. The method according to claim 35 wherein the compressing of the flexible duct comprises pre-compressing the flexible duct prior to inserting the flexible duct into the container.

40. The method according to claim 35 wherein the compressing of the flexible duct and inserting the flexible duct occur simultaneously in response to the plate being moved.

41. The method according to claim 30 wherein the holding of the container includes supporting the sides of the container as the flexible duct is being compressed.

42. The method according to claim 41 wherein the supporting of the sides includes moving support walls into abutting relationship with the side walls.

43. The method according to claim 41 wherein the holding of the container includes moving a plate adjacent the container rear open end.

44. The method according to claim 43 wherein the moving of the plate adjacent the container rear open end comprises moving a retaining fork having two opposing tines adjacent the container rear open end before the flexible duct is inserted within the container and the distal end of the flexible duct abutting the tines to retain the flexible duct within the container.

45. The method according to claim 44 wherein the tines pass through openings in the container and each tine is adjacent an opposite container side wall.

46. The method according to claim 45 wherein the moving of the barrier adjacent the container further comprises moving the plate between the tines of the retaining fork.

47. The method according to claim 43 wherein the holding of the container includes moving a support plate adjacent the container upper wall.

48. The method according to claim 30 wherein the sealing of the flap comprises moving the flap to cover the container front open end while the retainer is holding the flexible duct in the compressed state.

49. The method according to claim 48 wherein the sealing of the flap to the container comprises taping the flap to the container after the retainer is removed.

50. The method according to claim 48 wherein the closing of the flap further comprises moving the container through a chute to move a second flap to cover the container front open end after the retainer is removed and then taping the flaps to the container.

51. The method according to claim 30 and further comprising the dispensing of a collapsed container.

52. The method according to claim 51 and further comprising the erecting of the dispensed collapsed container.

53. The method according to claim 52 wherein the erecting of the dispensed collapsed container comprises applying a vacuum to the container lower surface to hold the container in a fixed location and applying a vacuum to the container upper surface and lifting the upper surface to erect the container.

54. The method according to claim 53 wherein the placing of the retainer adjacent the front open end further comprises the moving of a first retaining fork having two opposing tines adjacent the front open end after the flexible duct is compressed within the container beyond the front open end and the first end of the flexible duct abutting the tines to retain the flexible duct within the container.

55. The method according to claim 54 and further comprising the closing of the container rear opening by moving a second retaining fork having two opposing tines adjacent the container rear open end before the flexible duct is inserted within the container and the distal end of the flexible duct abutting the tines to retain the compressed flexible duct within the container between the retaining forks.

56. The method according to claim 55 wherein the compressing of the flexible duct comprises placing the flexible duct into a housing shaped to receive the flexible duct and moving a plate located in the housing into abutment with the first end of the flexible duct to compress the flexible duct as the plate moves.

57. The method according to claim 56 wherein the sealing of the flap comprises moving a flap associated with the container front open end to cover the container front open end and a flap associated with the container rear open end to cover the container rear open end while the tines of the first and second retaining forks are holding the flexible duct in the compressed state.

58. The method according to claim 57 wherein the sealing of the flap to the container comprises taping the flap of the container front open end and the flap of the container rear open end to the container after the retaining forks are removed.

59. The method according to claim 58 wherein the closing of the flap further comprises moving the container through a chute to move a second flap associated with the container front open end and a second flap associated with the container rear open end to respectively cover the container front and rear open ends after the retainer is removed and then taping the flaps to the container.

* * * * *